US006079950A

United States Patent [19]

Seneff

[11] Patent Number: 6,079,950

[45] Date of Patent: Jun. 27, 2000

[54] POOL RECIRCULATION CONTROL SYSTEM

[76] Inventor: William Seneff, 10279 N. 79th St., Scottsdale, Ariz. 85258

[21] Appl. No.: 09/013,245

[22] Filed: Jan. 25, 1998

[51] Int. Cl.[7] ..... F04B 49/00

[52] U.S. Cl. ..... 417/12; 417/32

[58] Field of Search ..... 417/12, 32

[56] References Cited

U.S. PATENT DOCUMENTS

| | | | |
|---|---|---|---|
| 4,421,643 | 12/1983 | Frederick | 417/12 |
| 4,505,643 | 3/1985 | Millis et al. | 417/12 |
| 4,676,914 | 6/1987 | Mills | 417/12 |
| 4,750,472 | 6/1988 | Frzekas | 417/12 |
| 4,945,942 | 8/1990 | Lund | 417/12 |

*Primary Examiner*—John Kwon
*Attorney, Agent, or Firm*—LaValle D. Ptak

[57] ABSTRACT

A control system is disclosed for a swimming pool or a spa recirculating system. Water is withdrawn from a pool or spa by a pump and supplied, through a filter, back to the pool. As is common with such systems, a controller is operated to initiate operation of the pump at pre-established time intervals (for example, once every twenty-four hours). The length of time or duty cycle that the pump is operated at each of these time intervals is determined by a temperature sensor which senses the water temperature. The temperature sensor supplies a signal to the controller to cause the pump to be operated for a longer period of time when the water temperature is above a threshold temperature, and to be operated for a shorter period of time when the water temperature is below the predetermined threshold.

11 Claims, 1 Drawing Sheet

POOL RECIRCULATION CONTROL SYSTEM

BACKGROUND

Swimming pools and spas typically operate in conjunction with a water recirculation system which is used for filtering the water in the pool and spa. Such recirculation systems often also are used in conjunction with chemical dispensing devices for dispensing chemicals, such as chlorine and other chemicals, into the pool. Most such systems do not continuously operate the pool recirculation pump, but rather, cause the pump to be operated for a pre-established period of time on a repeating cycle, usually every twenty-four hours.

The use of a control system which turns on the pump motor or the recirculating pump for pre-established periods of time during each twenty-four hour time interval (or other suitable interval) permits the pool recirculation and chemical addition to be effected during times of non-use of the pool. This is particularly desirable in conjunction with self-cleaning pools, which use "pop-up" heads located in the pool floor, since it is desirable to have all such heads recessed whenever the pool is in use.

The length of time the recirculating pump for the pool is operated for each of its operating cycles typically is set by the pool owner, without any scientific determination. For pools which are operated with relatively warm pool temperatures, it is been found, usually by trial and error, that a longer cycle of operation of the recirculating pump is required than at times when the pool water temperature is colder. In the southwest, for unheated pools, the difference is significant between summer operation (with relatively warm pool water) and winter operation (with relatively cold pool water). The pool operator usually manually adjusts the duty cycle of the operation of the recirculating pump arbitrarily, at various times of the year. Obviously, if the adjustment is not properly made, the recirculating pump may operate for a far longer duty cycle or time period in the winter than is necessary; or, conversely, the recirculating pump may be operated for much less than a desired length of time in warm weather.

It is desirable to provide a pool recirculation system which automatically adjusts the length of time of operation of the duty cycle for the recirculating pump in conjunction with the actual temperature of the water recirculated through the system.

SUMMARY OF THE INVENTION

It is an object of this invention to provide an improved water recirculation system for pools and spas.

It is another object of this invention to provide an improved method for controlling the water circulation in pools and spas.

It is an additional object of this invention to provide an improved temperature sensitive control system and method for operating the recirculating pump in a pool or spa.

It is a further object of this invention to provide a controller for operating the recirculating pump in a pool or spa which changes the duty cycle of operation of the pump in response to a temperature representative of the water temperature of the pool or spa.

In accordance with a preferred embodiment of the invention, a control system for the recirculating pump used in a pool or spa includes a temperature sensor providing a signal representative of the temperature of the water withdrawn by the pump from the pool. A controller is coupled with the pump to control the operation of the pump. The controller also is coupled to receive the signal from the temperature sensor to cause the pump operation to be effected for predetermined periods of time, the lengths of which are determined by the signal from the temperature sensor.

DETAILED DESCRIPTION

Figure 1:
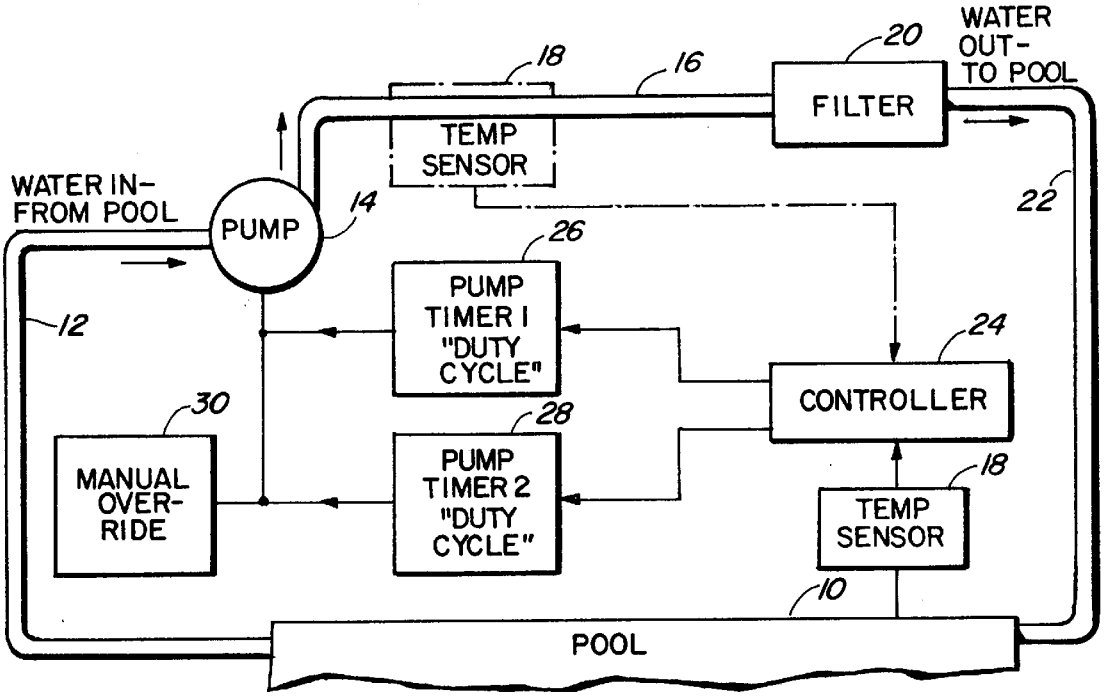
FIG. 1 is a block diagram of a preferred embodiment of the this invention.

Reference now should be made to the drawing. FIG. 1 is a schematic representation of a water recirculation system for a pool or spa, and a control system for operating the recirculating pump used in the water recirculation system. A pool 10 is shown coupled through an outlet pipe 12 to a recirculating pump 14 of a conventional type used in conjunction with swimming pools and spas. The pump is shown as supplying water through a pipe 16 to a filter 20, which may be a conventional filter used in conjunction with swimming pools, and from the filter 20 through a return line 22 back to the pool. Recirculation systems of the type which are illustrated in FIG. 1 are commonly used for swimming pools and spas for the purpose of filtering the water to maintain its clarity and freshness. In addition, the basic water recirculation system which is shown in FIG. 1 also may employ heaters, sanitizers, chemical dispensers and the like, in accordance with the desired operating characteristics and the environment in which it is used.

Typically, a recirculating pool system of the type shown in FIG. 1 is operated through a controller to turn the pump 14 on for a predetermined period of time on a regular cycle (usually, a twenty-four cycle). Thus, the pump 14 in a normal system is run with a fixed duty cycle of one or two hours, for example, once per day, as determined by the turn-on time which is established by the controller. The length of time of the duty cycle in a conventional system typically is established arbitrarily through an entry in an electronic memory or on a timer "wheel" of an electromechanical timer clock.

It has been found that home owners and pool owners frequently fail to cause the pump 14 to be operated at a duty cycle which is optimal for the particular time of year or temperature of the water in the pool 10. As a result, the pump 14 either is operated for too long or too short an interval, either of which have undesirable consequences.

The system shown in FIG. 1 utilizes a temperature sensor 18, which may either sense the water temperature in the pool 10 directly, as shown in solid lines in FIG. 1, or which may sense the temperature of the water circulated through any of the lines 12, 16 or 22 by the pump 14. This latter position is shown in dotted lines in FIG. 1. In either event, the temperature sensor 18 provides an electric signal representative of the temperature of the water in the pool 10 as sensed by the sensor 18. This signal may be of either of two forms. A first form is a threshold signal providing one output from the sensor 18 when the water temperature is below a pre-selected threshold, and another output when the water temperature is above this pre-selected threshold temperature. Alternatively, the temperature sensor 18 may provide a continuously variable output signal which is directly proportional to the water temperature being sensed by the sensor.

Whichever type of signal is sensed by the temperature sensor 18, this signal is supplied to a cycle timer controller 24 to control the duty cycle of operation of the pump 14. For the first example of signals from the temperature sensor 18, namely above or below a threshold, the controller 24 operates one or the other of two pump timer duty cycle circuits 26 and 28 for applying operating control signals to the pump 14. If, in the example being given, the temperature sensor provides an output indicative of a temperature below a pre-established threshold, the pump timer duty cycle circuit 26 is operated. The duty cycle of the circuit 26 is a pre-established "shorter" or minimum duty cycle. Thus, the pump 14 is operated for a predetermined "minimum" length of time whenever the circuit 26 is enabled by the controller 24.

If the temperature sensor 18, however, provides a temperature output signal indicative of a water temperature above the pre-established threshold temperature, the controller 24 operates the duty cycle timer circuit 28 to control the pump 14. The duty cycle of the timer circuit 28 is longer than the duty cycle of the timer 26; so that the pump automatically operates for a longer period of time, which is desired for higher water temperatures. This occurs automatically. If, in any one of the overall operating cycles controlled by the controller 24, the temperature sensed by the temperature sensor 18 drops back below the threshold, the next operation of the pump will be effected by the shorter time period duty cycle timer circuit 26.

In a more sophisticated version of the system, where the temperature sensor 18 provides an output signal which is directly proportional to the temperature, the controller 24 operates a single pump duty cycle timer circuit of the general type shown as 26 or 28, but where the cycle or length of time provided for the operating duty cycle of the pump 14 is variably controlled to be directly proportional to the sensed temperature (i.e. longer operating cycles for higher temperatures). This is in contrast with the two arbitrary duty cycle times which have been discussed above in conjunction with the "threshold" operation of the temperature sensor 18.

Whether the "threshold" operation or directly proportional signal representative of the temperature of the pool water is used, the operation is such that the pump 14 is operated for longer periods of time or a longer duty cycle for higher water temperatures than for lower water temperatures. This is effected automatically; so that failure of the home owner to properly adjust the duty cycle no longer is a factor. The system may be preset for the ideal operating conditions in any given environment.

As shown in FIG. 1, a manual override circuit 30 also may be used to turn on the pump 14 whenever desired, for whatever length of time the manual override circuit is enabled or operated. This is a feature which is used in conjunction with the remainder of the circuit shown in FIG. 1 to provide maximum flexibility to the operation of the system.

Figure 2:
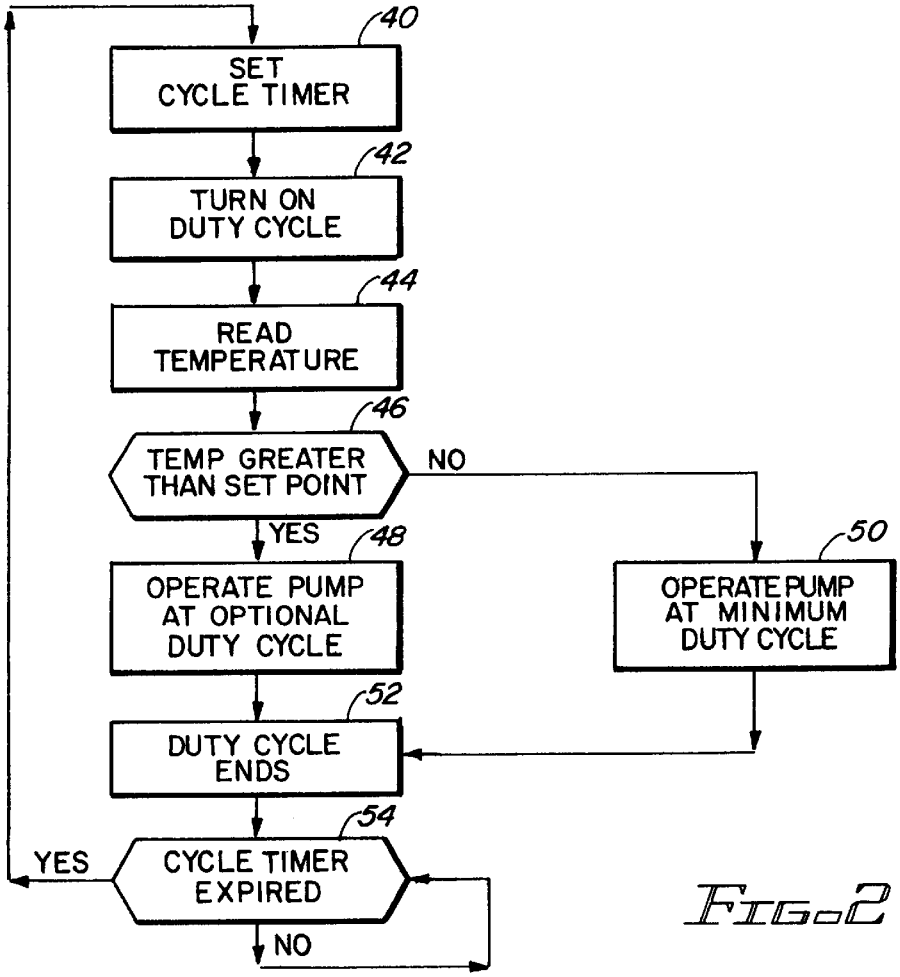
FIG. 2 is a flow chart of the operation of the system shown in FIG. 1.

FIG. 2 is a flow chart of the operation of the system shown in FIG. 1. At such time as the controller 24 reaches the beginning of a new cycle of operation (typically, once every twenty-four hours; but it could be at greater or lesser intervals) the cycle timer is set as shown at 40 in FIG. 2. This then causes the controller (24 of FIG. 1) to turn on the duty cycle at 42. The temperature of the temperature sensor 18 is read at 44; and a determination is made at 46, whether the temperature is greater than the set point or pre-established threshold. If the sensed temperature is greater than the threshold, the pump is operated at its optional or longer duty cycle at 48. On the other hand, if the sensed temperature is lower than the set point or threshold temperature at 46, the pump is operated at a shorter or minimum duty cycle at 50. The minimum duty cycle at 50 corresponds to the pump timer 26 described in conjunction with FIG. 1; and the operation at 48 corresponds to the operation of the pump timer 28, as described above in conjunction with FIG. 1. Whenever the duty cycle time is completed from either the duty cycle 48 or the duty cycle 50, a representation of the end of the duty cycle occurs at 52. If the cycle timer has expired at 54, the system is reset to set the cycle timer at 40, re-establishing the sequence of operation. If, however, at the end of the duty cycle at 52 the cycle timer has not expired at 54, continuous checks of it are made until expiration does occur.

The foregoing description of a preferred embodiment of the invention should be considered as illustrative only, and not as limiting. Various configurations for the water recirculation system will occur to those skilled in the art. The number of duty cycle timers which may be used in conjunction with the controller for controlling the operation of the pump 14 may be increased to a greater number than the two which are shown in FIG. 1. Various other changes and modifications will occur to those skilled in the art for performing substantially the same function, in substantially the same way, to achieve substantially the same result without departing from the true scope of the invention as defined in the appended claims.

What is claimed is:

1. A control system for a pool recirculation system having a pump for withdrawing water from a pool and for returning water to the pool, said control system including in combination:

a temperature sensor providing a signal representative of the temperature of water withdrawn by said pump from said pool; and a timer for periodically initiating operation of said pump at pre-established time intervals;

a controller coupled with said pump and coupled to receive said signal from said temperature sensor to operate said pump for different predetermined periods of time after operation has been initiated by said timer, the lengths of which are predetermined periods of time determined by said signal from said temperature sensor.

2. The combination according to claim 1 wherein said temperature sensor is located to sense the temperature of water in said pool.

3. The combination according to claim 2 wherein said controller includes at least first and second duty cycle timers coupled with said pump, with said first duty cycle timer operated to control said pump to operate for a first predetermined period of time with said signal from said temperature sensor indicative of a water temperature below a predetermined threshold, and with said second duty cycle timer operated to control said pump to operate for a second predetermined period of time in response to a signal from said temperature sensor indicative of a water temperature above said predetermined threshold.

4. The combination according to claim 3 wherein said second duty cycle timer operates said pump for the second predetermined period of time which is greater than the first predetermined period of time said pump is operated by said first duty cycle timer.

5. The combination according to claim 1 wherein said temperature sensor is located to sense temperature of water being recirculated through said pump.

6. The combination according to claim 5 wherein said controller includes at least first and second duty cycle timers coupled with said pump, with said first duty cycle timer operated to control said pump to operate for a first predetermined period of time with said signal from said temperature sensor indicative of a water temperature below a predetermined threshold, and with said second duty cycle timer operated to control said pump to operate for a second predetermined period of time in response to a signal from said temperature sensor indicative of a water temperature above said predetermined threshold.

7. The combination according to claim 6 wherein said second duty cycle timer operates said pump for the second predetermined period of time which is greater than the first predetermined period of time said pump is operated by said first duty cycle timer.

8. The combination according to claim 1 wherein said controller includes at least first and second duty cycle timers coupled with said pump, with said first duty cycle timer operated to control said pump to operate for a first predetermined period of time with said signal from said temperature sensor indicative of a water temperature below a predetermined threshold, and with said second duty cycle timer operated to control said pump for a second predetermined period of time in response to a signal from said temperature sensor indicative of a water temperature above said predetermined threshold.

9. The combination according to claim 8 wherein said second duty cycle timer operates said pump for the second predetermined period of time which is greater than the first predetermined period of time said pump is operated by said first duty cycle timer.

10. A method for controlling the operation of a pool recirculation system having a pump which is operated to withdraw water from a pool and for returning water to the pool, said method including in combination:

establishing a periodic cycle for turning on said pump;

sensing the temperature of the water withdrawn from the pool; and operating said pump for different predetermined periods of time, the lengths of which are determined by the sensed temperature of the water withdrawn from said pool.

11. The method according to claim 10 further including determining whether the temperature of the water withdrawn from the pool is greater than a pre-established threshold temperature and operating said pump for a first predetermined period of time when said sensed temperature is below said pre-established threshold; and operating said pump for a second predetermined time which is greater than said first period of predetermined time, when said sensed temperature is above said predetermined threshold.

* * * * *